US012053708B2

(12) United States Patent
Dor et al.

(10) Patent No.: US 12,053,708 B2
(45) Date of Patent: Aug. 6, 2024

(54) TRACKING THREE DIMENSIONAL PUZZLE COMPONENTS USING EMBEDDED IMAGE SENSORS AND CONTACTLESS ABSOLUTE POSITION ENCODERS

(71) Applicant: PARTICULA LTD., Binyamina (IL)

(72) Inventors: Udi Dor, Binyamina (IL); Amit Dor, Givat Shmuel (IL)

(73) Assignee: PARTICULA LTD., Binyamina (IL)

( * ) Notice: Subject to any disclaimer, the term of this patent is extended or adjusted under 35 U.S.C. 154(b) by 0 days.

(21) Appl. No.: 16/762,222

(22) PCT Filed: Nov. 9, 2018

(86) PCT No.: PCT/IB2018/058825
§ 371 (c)(1),
(2) Date: May 7, 2020

(87) PCT Pub. No.: WO2019/092648
PCT Pub. Date: May 16, 2019

(65) Prior Publication Data

US 2020/0346103 A1 Nov. 5, 2020

Related U.S. Application Data

(60) Provisional application No. 62/583,553, filed on Nov. 9, 2017.

(51) Int. Cl.
*A63F 9/08* (2006.01)
*A63F 9/24* (2006.01)

(52) U.S. Cl.
CPC .... *A63F 9/0842* (2013.01); *A63F 2009/2419* (2013.01); *A63F 2009/2442* (2013.01); *A63F 2009/2444* (2013.01); *A63F 2009/2451* (2013.01)

(58) Field of Classification Search
None
See application file for complete search history.

(56) References Cited

U.S. PATENT DOCUMENTS 8,398,470 B2 * 3/2013 Gillies ..... A63F 9/0842 463/9
11,077,359 B1 * 8/2021 Wigh ..... A63F 9/0842
2005/0243317 A1 11/2005 Baker et al.
(Continued)

FOREIGN PATENT DOCUMENTS

CN 105136302 12/2015
EP 2 130 569 12/2009
(Continued)

OTHER PUBLICATIONS

English translation of WO20161734761A1, pp. 1-13, see attached (Year: 2021).*

*Primary Examiner* — Tramar Harper
(74) *Attorney, Agent, or Firm* — The Law Office of Joseph L. Felber

(57) ABSTRACT

Disclosed herein are embodiments of three-dimensional puzzles that implement image sensors to read signatures of individual shell segments to thereby determine shell segment patterns. Also disclosed are embodiments of systems that implement RGB sensors adjacent gradient color maps to provide contactless absolute position encoders.

10 Claims, 10 Drawing Sheets

(56) References Cited

U.S. PATENT DOCUMENTS

| | | | | |
|---|---|---|---|---|
| 2008/0070657 | A1* | 3/2008 | Kratz | A63F 9/24 463/9 |
| 2010/0261514 | A1* | 10/2010 | Gramelspacher | A63F 13/24 463/9 |
| 2012/0302303 | A1* | 11/2012 | Rosendo | A63F 9/0842 463/9 |
| 2015/0076766 | A1* | 3/2015 | Liu | A63F 9/0826 273/153 S |
| 2018/0161668 | A1* | 6/2018 | Chen | A63F 9/0842 |
| 2019/0374849 | A1* | 12/2019 | Limaye | A63F 9/0842 |

FOREIGN PATENT DOCUMENTS

| | | | | |
|---|---|---|---|---|
| EP | 2130569 | A2 * | 12/2009 | A63F 9/0834 |
| WO | 2016/173476 | | 11/2016 | |
| WO | WO-2016173476 | A1 * | 11/2016 | A63F 9/0842 |
| WO | WO-2018138586 | A2 * | 8/2018 | A63F 9/0842 |

* cited by examiner

TRACKING THREE DIMENSIONAL PUZZLE COMPONENTS USING EMBEDDED IMAGE SENSORS AND CONTACTLESS ABSOLUTE POSITION ENCODERS

CROSS REFERENCE TO RELATED APPLICATIONS

This application is a National Phase of PCT Patent Application No. PCT/IB2018/058825 having International filing date of Nov. 9, 2018, which claims the benefit of priority under 35 U.S.C. § 119(e) of U.S. Provisional Application No. 62/583,553, filed on Nov. 9, 2017, The contents of the above applications are all incorporated by reference as if fully set forth herein in their entirety.

BACKGROUND

Puzzles of various types for people of all ages are embodied having a wide selection of shapes, sizes, and complexity. One popular non-limiting example of a three-dimensional puzzle is known as the Rubik's Cube (originally called the "Magic Cube"), referenced hereinbelow as simply "cube" and illustrated in FIG. 1 as cube 30. Cube 30 has six faces 32 (three of them visible in FIG. 1), and each face 32 has a three-by-three array of nine face segments 34 (not all labeled for clarity).

The outer surface of the cube 30 is formed by an aggregation of what appears to be twenty-six (26) smaller component cubes, hereinafter referred to as "cubelets," 36, 38, 40. The cubelets 36, 38, 40 are not truly cubes but appear so from outside the cube 30 because their face segments 34 on the outer surface of the cube 30 resemble the faces that true cubes would have on the outer surface of the cube 30, if they were the components from which cube 30 were made. That is, the six central cubelets 36 at the center positions of faces 32 each have one face segment 34, the twelve central edge cubelets 38 at the edges of the faces 32 but not at the vertices (corners) of faces 32 each have two face segments 34, and the eight vertex cubelets 40 at the vertices of the cube 30 each have three face segments 34. Each cubelet 36, 38, 40 is free to rotate relative to an adjacent cubelet 36, 38, 40.

Within the cube 30 is an inner core, which may be embodied, as non-limiting examples, as the core 42 of cube 44 in FIG. 2A or the core 46 of cube 48 in FIG. 2B. In the embodiment of FIG. 2A, the core 42 resembles a point in space from which six posts 50 extend outward. In the embodiment of FIG. 2B, the core 46 takes a spherical form with posts 52 mounted thereon. In both examples, each post 50 or 52 contacts one of the six central cubelets 54, 56 on a different face of the cube 44, 48. The posts 50, 52 are free to rotate relative to the core 42, 46 or relative to the central cubelets 54, 56 they contact, thereby enabling each face of the cube 44, 48 to rotate relative to the core 42, 46 about the axis of the post 50, 52 it contacts. The posts 50, 52 for these cube 44, 48 constrain the central cubelets 54, 56 from axial movement along the posts 50, 52 and away from the core 42, 46.

The central edge cubelets and the vertex cubelets (not shown in FIGS. 2A and 2B) do not contact the posts 50, 52. They however do not separate from the cube 44, 48 due to elaborate shapes of their bases. These bases enable the cubelets to slide relative to each other and to return to form the cube shape at the completion of ninety-degree rotations (discussed below). The bases also constrain the central cubelets 54, 56 from axial movement along the posts 50, 52 toward the core 42, 46 and away therefrom. The sophisticated details of the base construction are known and thus beyond the scope of the present disclosure.

Within a single face 32, each face segment 34 is free to move relative to the others. As illustrated in FIG. 1, two adjacent faces 32 share a common edge 58, and a face segment 34 sharing an edge with a face segment 34 of an adjacent face 32 is constrained not to move relative to that face segment 34 of the adjacent face 32. As alluded above, for each vertex face segment 34 there are three face segments 34, in which each face segment 34 is adjacent to the other two face segments 34, sharing a common vertex 60, and the three face segments 34 adjacent the common vertex 60 are constrained not to move relative to each other. As also alluded above, for each non-vertex edge face segment 34 there is another non-vertex edge face segments 34 on an adjacent face 32, and the two non-vertex edge face segments 34 are constrained not to move relative to each other. Accordingly, each face 32 has a center face segment 34, four vertex face segments 34, and four non-vertex edge face segments 34.

With reference to the cube 62 in FIG. 3, edge face segments 64 on one face 66 may be repositioned to an adjacent face 68 by rotating them ninety degrees relative to the rest of the cube 62. The axis 70 of rotation is parallel to both the face 66 containing the edge face segments 64 before the rotation and the face 68 containing the edge face segments 64 after the rotation. This rotation repositions nine cubelets 72 relative to the rest of the cube 62. Accordingly, the rotating face segments consist of those on one face 74 plus the edge face segments from the adjacent faces that share an edge with that one face 74.

Cubes 30 and 62 of FIGS. 1 and 3 are often referred as "3×3 cubes," as they have 3×3 arrays of cubelets at each face. Three-dimensional puzzles of this nature are not limited to 3×3 cubes, though. The cubes can have different amounts of cubelets on a face, and two examples are the 2×2 and 4×4 cubes. The shells of the three-dimensional puzzles are also not limited to cubical form, and the shell segments are not limited to cubelets. Two examples are three-dimensional puzzles having spherical or pyramidal shells. Accordingly, features of the invention disclosed herein are not limited to implementations on 3×3 cubes.

With respect to cubes such as those of FIGS. 1 and 3, the face segments may have one of six colors, such as white, red, blue, orange, green, and yellow. One typical way of playing a game with cube 30, 62 is to rearrange the cubelets of the cube 30, 62 so that each face has face segments of only one color. Three-dimensional puzzles of other shapes and numbers of shell segments are constructed and played analogously. Also, neither the prior art nor applications of inventive concepts discussed below are limited to face segments distinguished by colors. Instead, the face segments may differ by displaying thereon differing numbers, shapes, patterns, and symbols, as non-limiting examples.

Both beginning and advanced players have a need for guidance to aid in increasing proficiency in solving the puzzle. For beginners, arranging all face segments accordingly is both complicated and challenging, and many players seek assistance through a variety of text and/or video guides. These guides present solution algorithms that many players can find difficult to understand, and such has led to a need for a system of interactive feedback to guide new users more easily to solutions. More advanced players can regard quickly solving these puzzles as a type of competition, sometimes referred to as "speedcubing" and "speedsolving," Leagues and competitions are available in which the players strive to solve the puzzles as fast as possible. In International Application WO 2018/138586, herein incorporated by reference in its entirety, the present inventors describe a system for interactive feedback and guidance suitable for both new and advanced players employing optical sensors to track component movement.

International Application WO 2018/138586 also describes how to track shell segment patterns using an elaborate combination of unique signatures located at the shell segments and signature sensors within the shell. Types of signature sensors disclosed included RFID, NFC, and optical sensors, and one type of optical sensor discussed was an RGB sensor.

The inventors realized that other types of optical sensors could be used to determine and track shell segment patterns, and accordingly they sought new and inventive alternatives to RGB sensors to read the signatures of individual shell segments. The inventors also discovered that the use of RGB sensors for contactless position monitoring could be exploited for uses beyond those for three-dimensional puzzles.

SUMMARY

Embodiments of the present invention implement image sensors to read signatures of individual shell segments to determine shell segment patterns. Alternate embodiments implement RGB sensors to provide contactless absolute position encoders for uses other than for determining shell segment patterns of three-dimensional puzzles.

More specifically, the invention maybe embodied as a three-dimensional puzzle having a shell, a core, multiple unique sensors, and at least one image sensor. The shell has at least four faces and is formed by multiple shell segments, each shell segment being free to move relative to an adjacent shell segment. The core is within the shell, and the faces are free to rotate relative to the core about axes extending from the core toward the faces. The multiple unique signatures are located at the shell segments. The at least one image sensor is within the shell and views the unique signatures to provide data to processing circuitry based on sensed signatures to determine shell segment motion.

The invention may also be embodied as a contactless absolute position encoder having an RGB sensor and a gradient map. The RGB sensor is affixed to a first platform and has a field of view. The gradient color map is within the field of view of the RGB sensor and is affixed to a second platform. The RGB sensor provides output indicative of the absolute position of the first platform relative to the second platform.

Embodiments of the present invention are described in detail below with reference to the accompanying drawings, which are briefly described as follows:

BRIEF DESCRIPTION OF THE DRAWINGS

The invention is described below in the appended claims, which are read in view of the accompanying description including the following drawings, wherein:

DETAILED DESCRIPTION

Disclosed herein are implementations of optical sensing to identify the colors of the face segments of three-dimensional puzzles, their positions on the puzzles' faces, and their motion relative to other face segments. Embodiments of the invention monitor the puzzle state as well as movements executed by the player. Multiple embodiments of optical sensing configurations are described. The sensors are positioned inside the puzzle, such as at or inside the core, connected, and powered using for example the techniques used for optical sensors described in International Application WO 2018/138586. Electronic deployment inside the cube enables when desired the use of lighting sources such as LEDs to facilitate clear optical sensing. The optical readings may be further processed to evaluate the puzzle state and movements either by a companion CPU/DSP residing in the same core or by sending the raw data to external processing unit, such as that in a mobile phone. Further details of how the internal CPU and wireless device are wired and powered are provided in International Application WO 2018/138586.

Embodiments discussed below frequently reference the well-known 3×3 Rubik Cube, that is the puzzle with nine face segments on each of six sides. Such examples are merely illustrative and do not limit the scope of the invention to exclude different numbers of elements, and the scope of the invention further does not exclude face segments that may differ by displaying thereon differing numbers, shapes, patterns, and symbols, as non-limiting examples of ways how face segments may differ.

For discussions below, the term "vertex element" references the element of the cubic puzzle that has three vertex face segments (one vertex face segment from each of the three faces of the vertex). The vertex segment is marked inside (that is, not marked on or near the face segments facing outward) with a unique signature, or code, that identifies the vertex segment and its three-dimensional orientation. That is, the code indicates the colors of the three face segments and their orientation.

Figure 4:
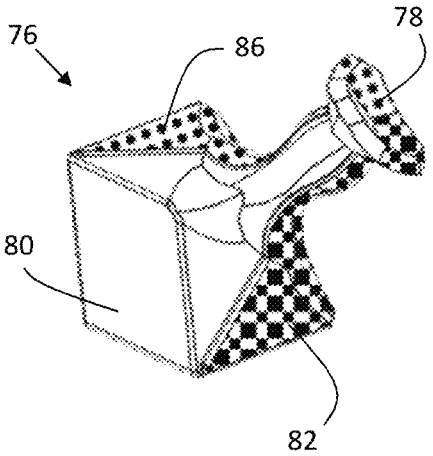
FIG. 4 provides an illustration of a vertex element of a three three-dimensional puzzle in accordance with one embodiment of the invention.

One example of such code for a vertex element 76 is illustrated in FIG. 4. The coded area 78 is located in the upper-right region in the illustration. The area 78 is visible from the cube's core. As FIG. 4 shows, the colors of the face segments (only face segment 80 visible in the drawing), which face outside, are the same as the colors in the coded area 78, which is visible from the core. Thus, an example orientation of the face segments red-downward 82, yellow-to-the-left 84, blue-to-the-back 86 is readily apparent from the core.

The non-vertex edge segments also have colors on the inside indicating the colors of the two outside face segments. The correspondence of the colors on the coded region matching the colors of the face segments is a natural result when the vertex elements and the non-vertex edge segments are manufactured using three and two, respectively, separate solid-colored pieces. For example, such configuration is common when manufacturing the Dayan Cube, which competes with the Rubik's Cube.

Figure 5:
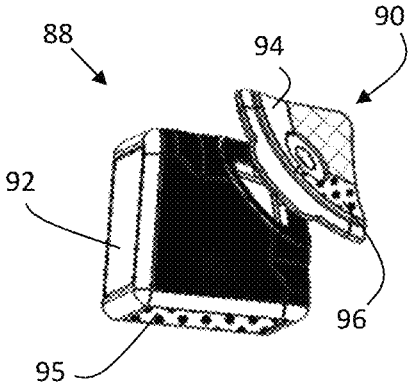
FIG. 5 provides an illustration of a vertex element of a three three-dimensional puzzle in accordance with an embodiment that is an alternative to the embodiment of FIG. 4.

However, some cubes, such as the Rubik's Cube, are manufactured using plastic of a single color, and the face segments are later colored, for example, by placing stickers thereon. Accordingly, stickers, paints, or other visually-distinctive indicia may be applied to the inner areas for coding, such as provided for a vertex element 88 having a coded area 90 as illustrated in FIG. 5. In this example, the left-facing face segment 92 and the corresponding part 94 in the coded area 90 are each provided with stickers having the same color, as is also provided to the bottom-facing face segment 95 and its corresponding part 96 in the coded area 90. (A third face segment is not visible in FIG. 5.)

Figure 6A:
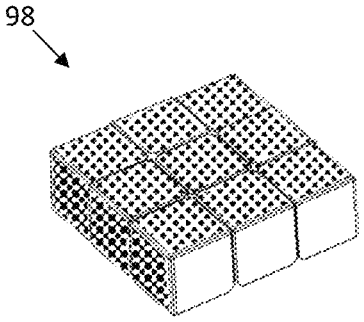
FIGS. 6A, 6B, 7A, and 7B illustrate outside faces and corresponding inside coded areas for alternate embodiments of the invention.
Figure 6B:
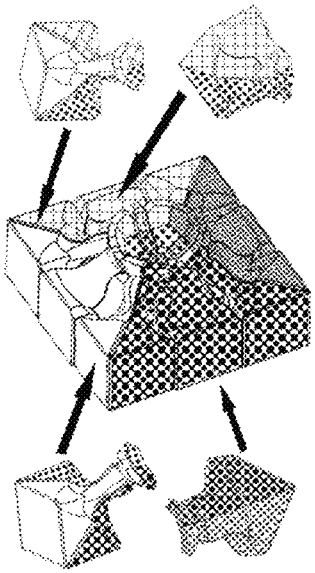
Figure 7A:
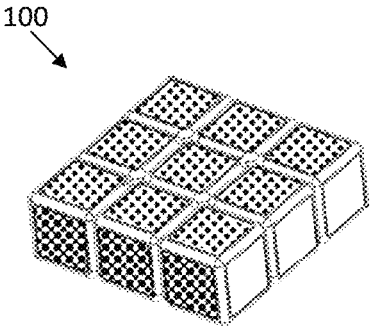
Figure 7B:
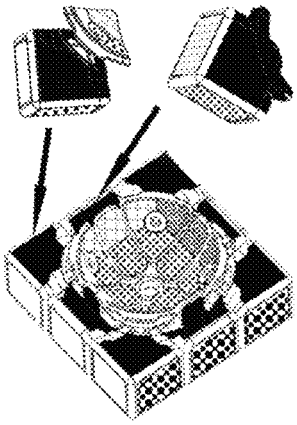

FIGS. 6A, 6B, 7A, and 7B illustrate outside faces and corresponding inside coded areas for the Dayan and Rubik's Cubes. Regarding the Dayan Cube, FIG. 6A provides the outside view of face 98, and FIG. 6B provides the corresponding inside coding (not labeled for clarity). Regarding the Rubik's Cube, FIG. 7A provides the outside view of face 100, and FIG. 7B provides the corresponding inside (not labeled for clarity) with added coloring on both the outside and inside.

Figure 8A:
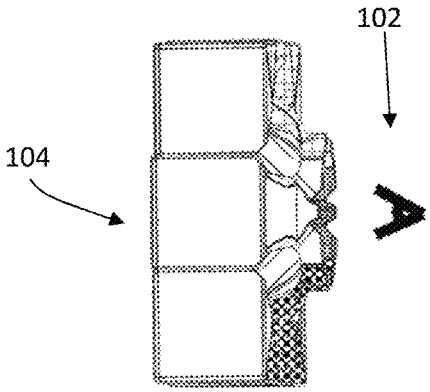
FIG. 8A provides a side view the position of a system of an image sensor and cubelets in accordance with an embodiment of the invention.
Figure 8B:
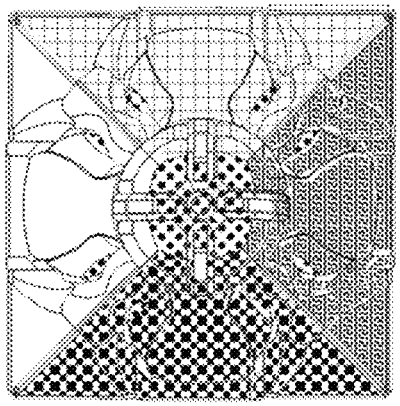
FIG. 8B an alternate view a component of the system of FIG. 8A.

To read the codes, an image sensor, such as a CCD array, a CMOS array, or a camera, is placed inside the cube at or near the core, which holds the system electronics (see International Application WO 2018/138586 for details). Accordingly, the system processes the viewed codes of each piece to determine the colors of each piece and their orientations. To show a system of an image sensor and cubelet codes, FIG. 8A provides a side view the position of an image sensor, denoted by an "eye" symbol 102, viewing the inside of one side 104 of a cubic puzzle, and FIG. 8B shows the front view of the side 104 facing the image sensor.

Figure 9A:
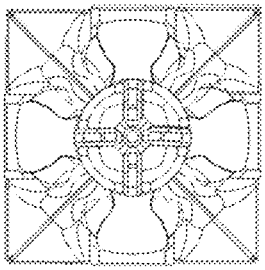
FIG. 9A illustrates the inside view of a component of a three-dimensional puzzle, and FIG. 9B indicates pattern information of the component of FIG. 9A.
Figure 9B:
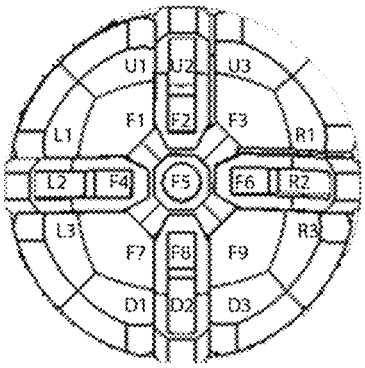

The innermost region of the image that the image sensor views indicates the face segment colors of the face that shall be called the "Front Face," in the context of the present discussion, and the remaining portion of the viewed image indicates the colors of the bounding face segments of the Up, Left, Right, and Down Faces. FIG. 9A illustrates the inside view of the front face, and FIG. 9B indicates, in an enlarged view of the center of the view of FIG. 9A, the particular face segments to which the colors correspond, using the notation F=Front, U=Up, L=Left, R=Right and D=Down.

Figure 10A:
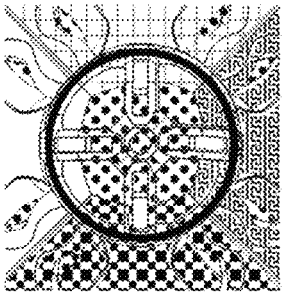
FIGS. 10A and 10B illustrate the change in images viewed by an image sensor when a side of a three-dimensional puzzle rotates.
Figure 10B:
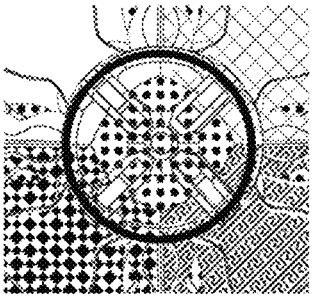

Additionally, continuous image readings and image processing enable the system to compare new images to previous images to identify small movements executed by players. Such processing may be either performed by an inner controller (inside the core near the image sensor) or by streaming the raw/compressed image data to an external processing unit, such as in a mobile device, to identify small movements. For example, with reference to FIGS. 10A and 10B, the system can identify a starting pattern of cubelets from the image sensor's view illustrated in FIG. 10A and then identify a subsequent 45 degree face rotation from its view illustrated in FIG. 10B.

Figure 11:
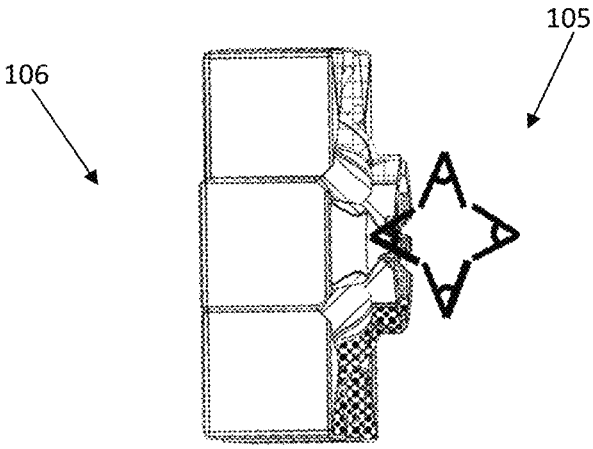
FIG. 11 illustrates the deployment of four image sensors relative to one face of a three-dimensional puzzle in accordance with an embodiment of the invention.

One exemplary embodiment of the invention tracks the movements of all face segments, that is, the face segments on the side of the cube directly in front of the image sensor discussed above and also the face segments of the other five faces, by deploying five more image sensors to view the coded regions of the additional vertex elements and non-vertex edge segments. FIG. 11 illustrates the deployment of four such image sensors 105 relative to one face 106.

Figure 1:
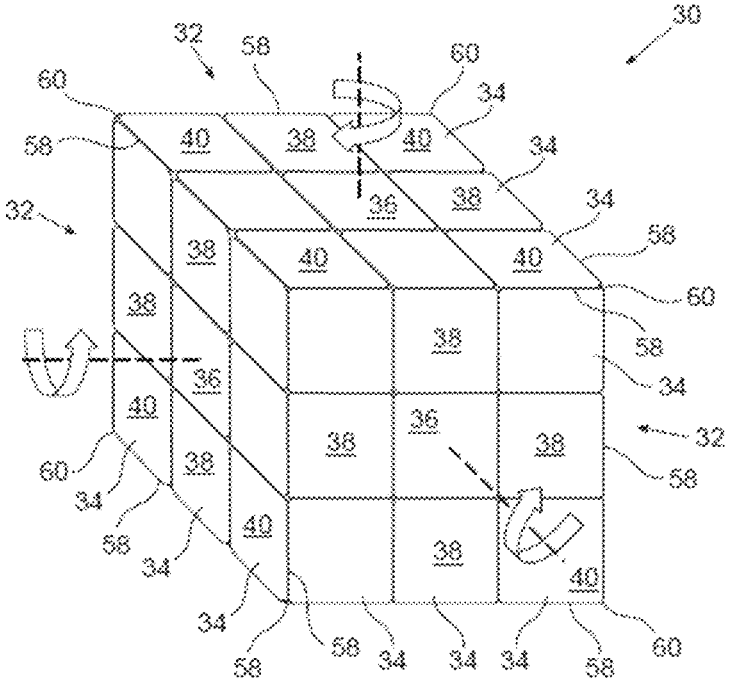
Fig. 1(prior art)
FIG. 1 shows a 3×3 cube as one type of prior art three-dimensional puzzle.
Figure 2A:
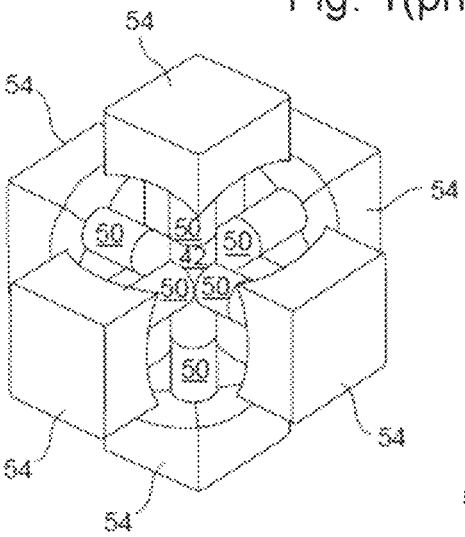
Fig. 2A(prior art)
FIGS. 2A and 2B show typical prior art cores for three-dimensional puzzles.
Figure 2B:
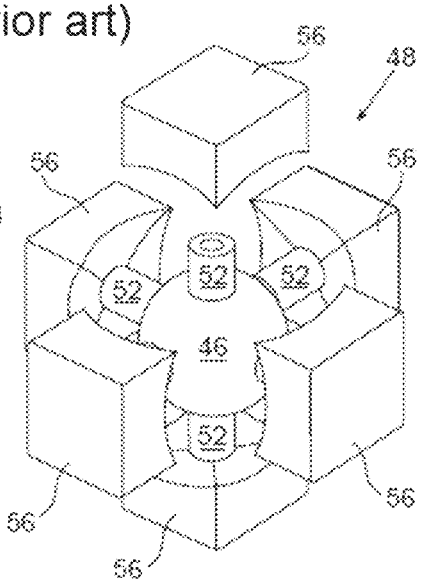
Fig. 2B(prior art)
Figure 3:
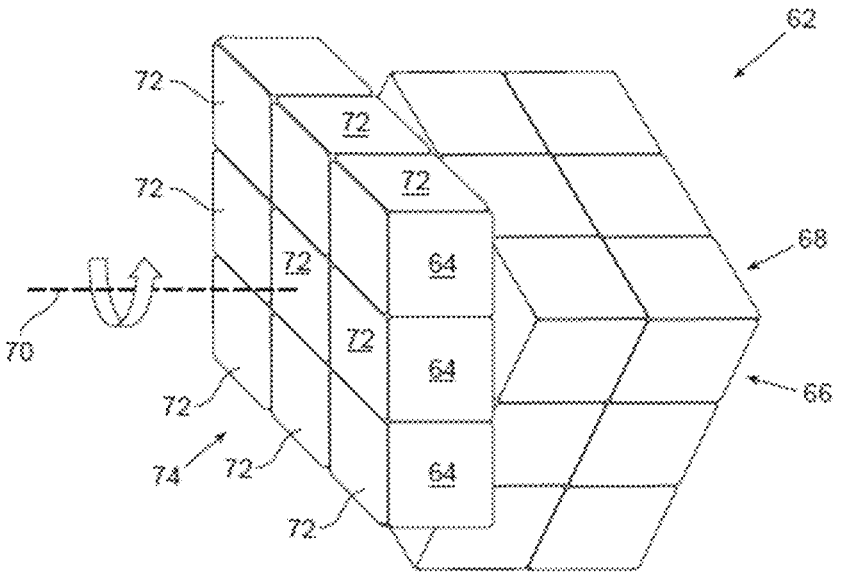
Fig. 3 (prior art)
FIG. 3 illustrates the rotation of a face of a prior art three-dimensional puzzle.

The Background section of the present disclosure discusses posts of three-dimensional puzzles that extend outward from the cores and support central cubelets. (Reference is made to posts 50 of FIG. 2A and to posts 52 of FIG. 2B.) The posts supporting central face segments, if not made of transparent or mesh-type material, obscure part of the image sensors' views of the code regions. However, the obstruction produced by the post can be reduced so that enough of the coded regions become visible to the image sensors.

Figure 12A:
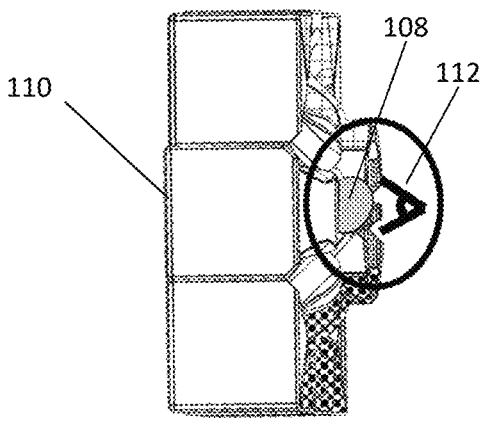
FIGS. 12A and 12B provide illustrations of alternate embodiments of the invention implementing a hemispherical mirror and fewer image sensors.
Figure 12B:
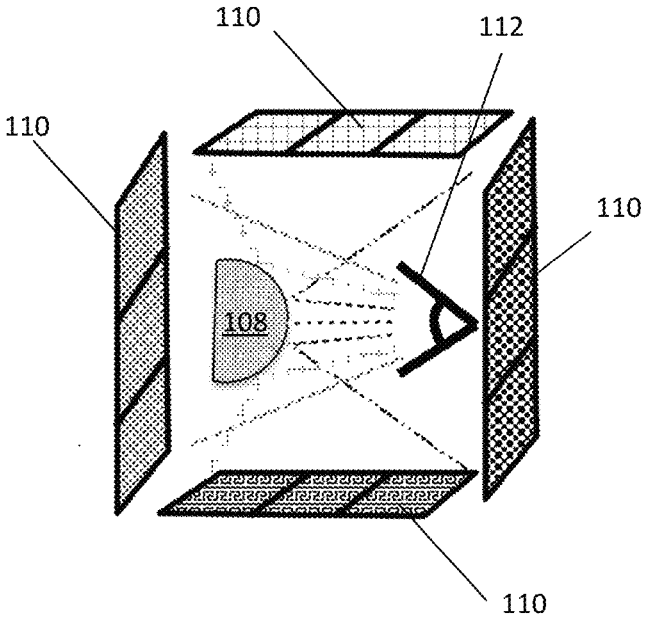

The alternate embodiment illustrated in FIGS. 12A and 12B (not to scale for clarity) uses fewer optical sensors and accordingly lowers costs. In this embodiment, a hemispherical mirror 108 is positioned to provide a view of the coded regions of all sides 110 of a puzzle to a single image sensor 112. Lenses (not shown for clarity) may also be used if necessary to aid the image sensor in viewing the coded regions. FIG. 12A shows the location of mirror 108, and FIG. 12B shows how four interiors of sides 110 of the cube are visible to the image sensor. FIG. 12B provides broken lines to represent the lines of sight to the left, right, upper, and bottom faces. Lines (not shown) analogous to the lines representing the upper and bottom faces, when rotated appropriately, would represent the lines of sight to the front and back faces (also not shown for clarity).

Embodiments discussed above determine the color of each face segment by viewing each face segment's corresponding coded region by an image sensor. This process can be denoted "absolute sensing." This process differs from another process that determines the color of each face segment by using knowledge of the puzzle pattern's initial state, that is, the color of each face segment at a starting time, and knowledge of subsequent face rotations. This process is analogous to the use of dead reckoning for navigation, and the process is discussed in detail in International Application WO 2018/138586.

As disclosed in detail in U.S. Provisional Application No. 62/583,553 and in International Application WO 2018/138586, an RGB sensor is another type of optical sensor that can be implemented as a signature sensor to read coded regions of the shell segments of three dimensional puzzles. The coded regions have unique signatures in the form of color gradient maps. The output of an RGB sensor is a single color, represented by three components, R, G, and B, as opposed to multiple three-component values, one for each image pixel, which is the output of an image sensor. In other words, an image sensor provides many values, which result in an output of the many different colors (if the object sensed has many colors) within the image sensor's field of view. In contrast, the output of an RGB sensor is a single three-component value determined by an integration of all the colors sensed within its field of view.

Figure 13A:
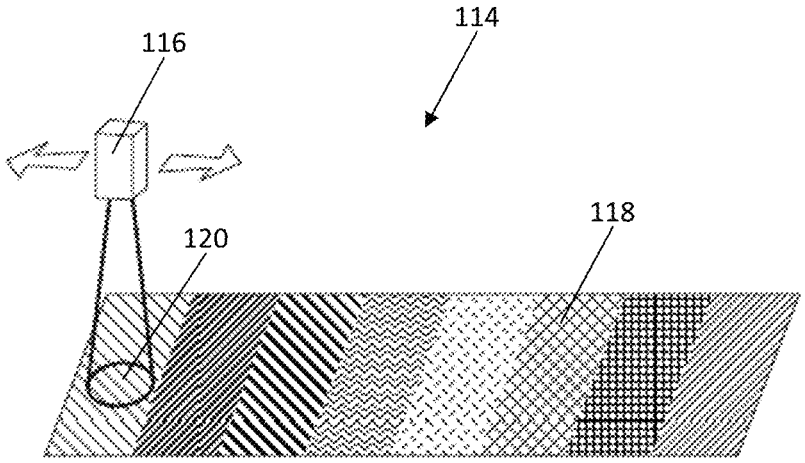
FIGS. 13A and 13B provide illustrations of alternate embodiments of linear contactless absolute position encoders in accordance with the invention.

The inventors found that, by directing an RGB sensor to view a gradient color map and associating a unique color to a unique position, the RGB sensor can be utilized to provide absolute position information. Further, the inventors realized that uses for such position encoding were not limited to determining positions of shell segments of three-dimensional puzzles. Accordingly, the following embodiments are discussed:

FIG. 13A provides an illustration of another embodiment of the invention, which is a linear contactless absolute position encoder 114. Two of its primary components are an RGB sensor 116 and a gradient color map 118, both of which are affixed to its own platform (not shown for clarity). As shown in FIG. 13A, the gradient color map 118 is within the field of view 120 of the RGB sensor 116. Accordingly, the RGB sensor 116 provides output indicative of its absolute position, and hence the absolute position of its platform, relative to the gradient color map 118 and its platform. Optionally, a light source (not shown) may be added directed to illuminate the field of view 120 of the RGB sensor 116. The light source may be an LED, as a non-limiting example.

Figure 13B:
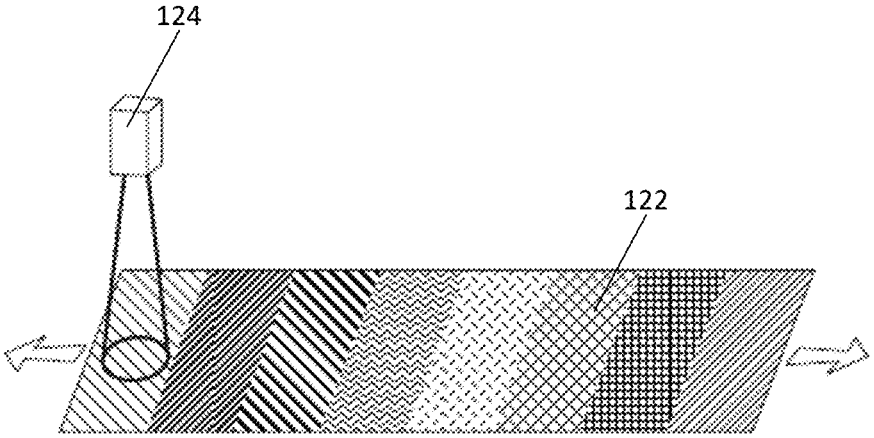

FIG. 13B provides an illustration of an alternate to the embodiment of FIG. 13A. In the embodiment of FIG. 13A, the gradient color map 118 and its platform are static and the RGB sensor 116 moves linearly, and in the embodiment of FIG. 13B, the gradient color map 122 and its platform moves linearly and the RGB sensor 124 and its platform are static.

Figure 14A:
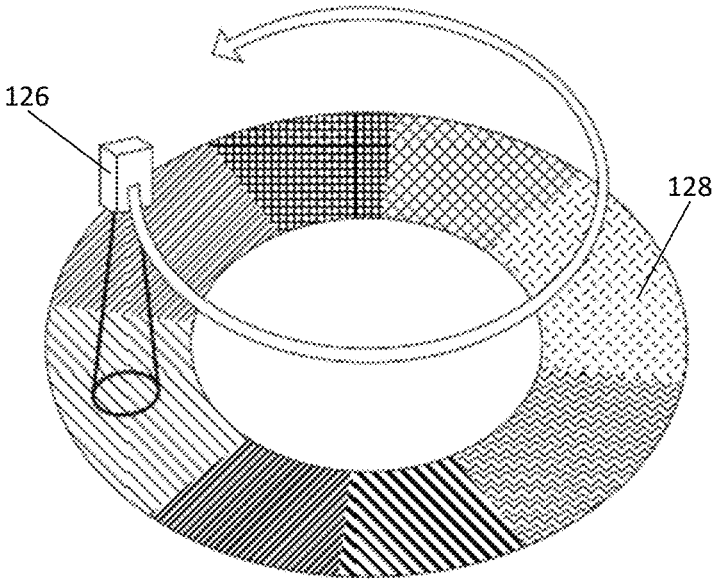
FIGS. 14A and 14B provide illustrations of alternate embodiments of angular contactless absolute position encoders in accordance with the invention.
Figure 14B:
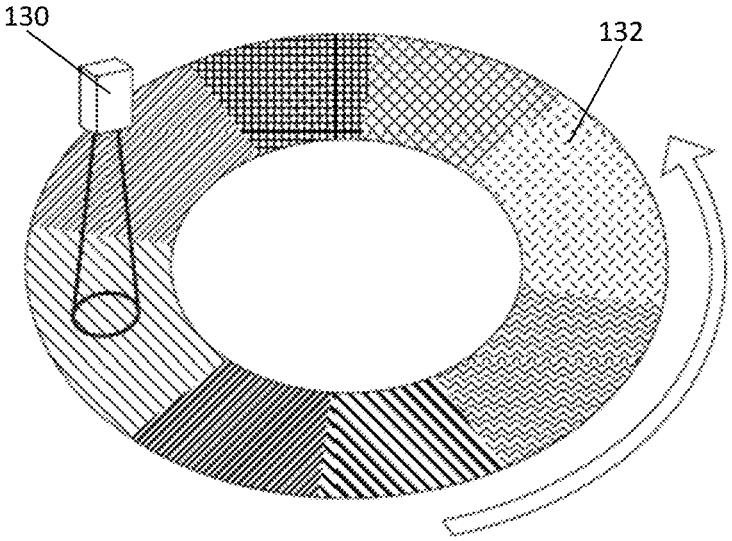

FIGS. 14A and 14B each provide illustrations for angular contactless absolute position encoders. In FIG. 14A, an RGB sensor 126 is affixed to a rotating platform (not shown) while a gradient color map 128 and its platform (not shown) are static. In FIG. 14B, the RGB sensor 130 and its platform (not shown) are static while the gradient color map 132 and its platform (not shown) rotate. For an alternate embodiment of an angular contactless absolute position encoder, the gradient color map can be provided with a cylindrical shape and the RGB sensor repositioned to so that its field of view is properly focused thereon.

Figure 15A:
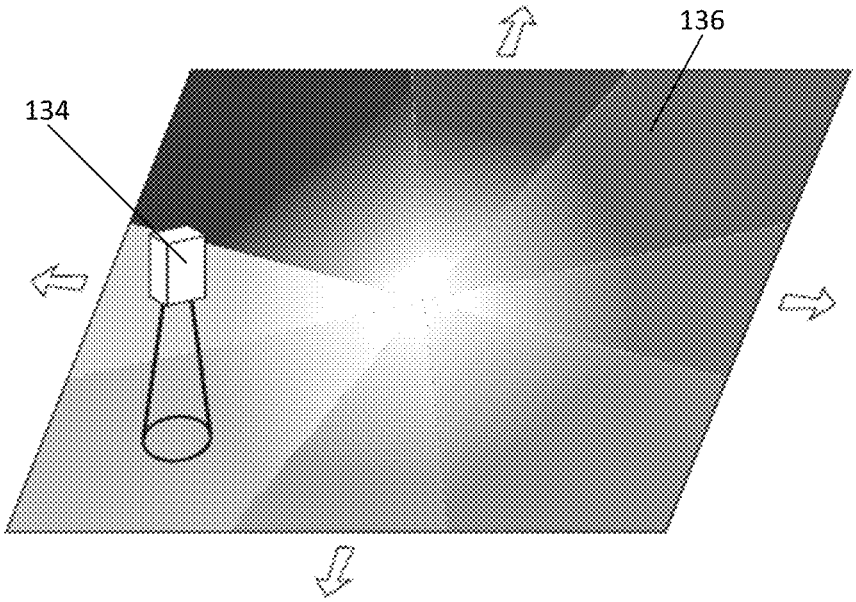
FIGS. 15A, 15B, 16A, and 16B provide illustrations of alternate embodiments of two-dimensional contactless absolute position encoders.
Figure 15B:
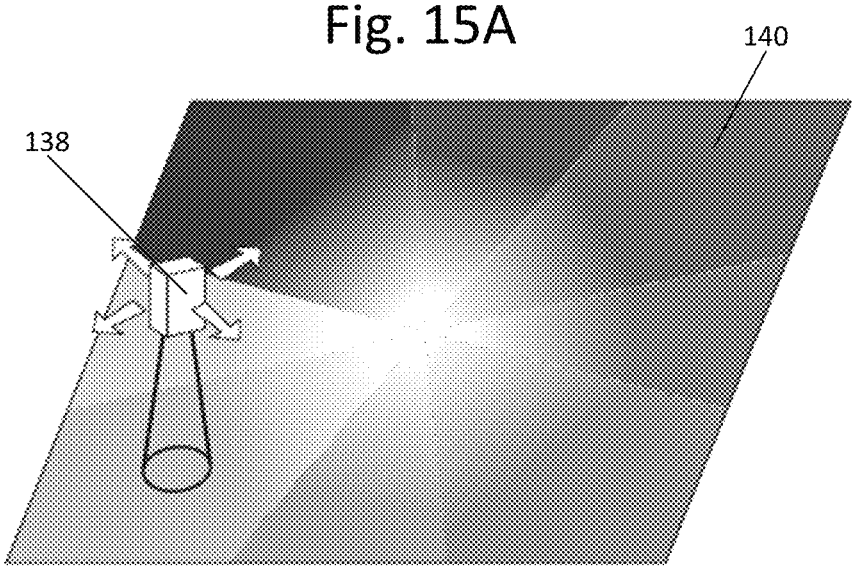

FIGS. 15A and 15B each provide illustrations of two-dimensional contactless absolute position encoders. They employ planar gradient color maps having transitions of colors in two dimensions. Accordingly, the RGB sensors provide output indicative of two dimensions of their absolute positions relative to their gradient color maps. In FIG. 15A, the RGB sensor 134 and its platform (not shown) are static while the gradient color map 136 and its platform (not shown) are free to move in two coplanar dimensions. In FIG. 15B, the RGB sensor 138 and its platform (not shown) move in two coplanar dimensions and gradient color map 140 and its platform (not shown) are static.

Figure 16A:
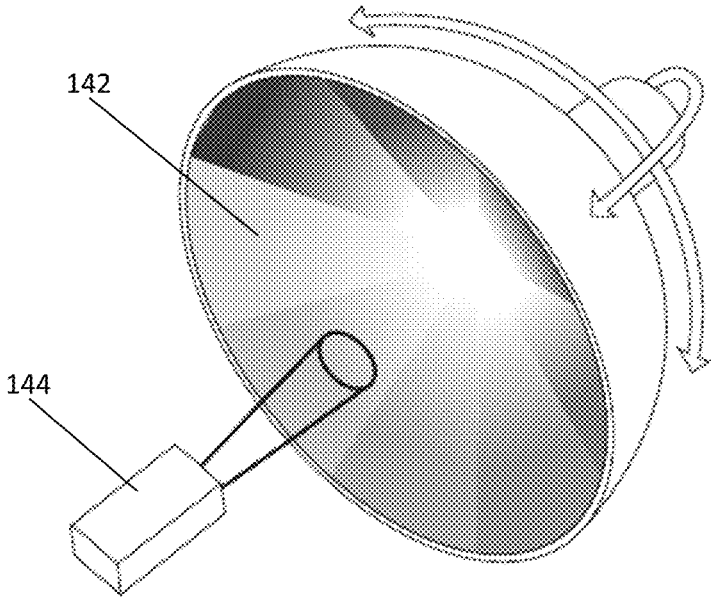
Figure 16B:
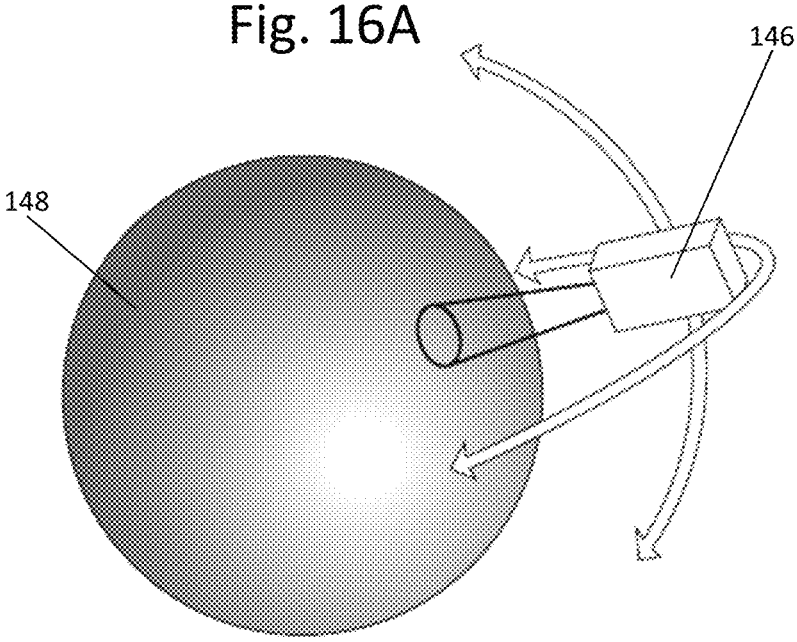

FIGS. 16A and 16B each provide illustrations of alternate embodiments of two-dimensional contactless absolute position encoders. In these embodiments, the gradient color maps have a spherical or segmented-spherical shape, and the respective RGB sensors provide output indicative of two dimensions, polar and azimuthal angles, of their positions relative to their respective gradient color maps. In FIG. 16A, the segmented-spherical the gradient color map 142 is free to move with two angular degrees of freedom while the RGB sensor 144 is static. In FIG. 16B, the RGB sensor 146 moves with two angular degrees of freedom and the gradient color map 148, almost a complete sphere, is static. An exemplary usage of the embodiment of FIG. 16A is to affix the gradient color map 142 to a joystick as its platform while the RGB sensor 144 is affixed to the joystick's base as its platform. Thus, the two-dimensional contactless absolute position encoder indicates the orientation of the joystick. An exemplary usage of the embodiment of FIG. 16B is to affix the gradient color map 148 to the "ball" of a robot ball-and-socket joint as its platform, while the RGB sensor 146 is affixed to the robot's corresponding appendage as its platform. Thus, the two-dimensional contactless absolute position encoder indicates the orientation of the appendage relative to the rest of the robot attached thereto.

The location of any point on the gradient color maps 142, 148 in FIGS. 16A and 16B can be provided by two coordinates of a spherical coordinate system, and the location of any point on a cylindrical gradient color map can be provided by two coordinates of a cylindrical coordinate system. If a Cartesian coordinate system were used instead, the same gradient color maps would be described as extending in three dimensions of a Cartesian coordinate system.

Many types of surfaces could be described as extending in three dimensions of a Cartesian coordinate system. One example is that of an automobile surface. A gradient color map can be affixed thereto, so that the car surface is the platform of the gradient color map. An RGB sensor can be affixed to an ultrasonic testing device, which becomes the platform for the RGB sensor. The color map and RGB sensor thus become a contactless absolute position encoder that indicates which part of the irregularly-shaped (that is, not flat, cylindrical, spherical, or other typical geometric shape) automobile surface the ultrasonic testing device is checking.

Having thus described exemplary embodiments of the invention, it will be apparent that various alterations, modifications, and improvements will readily occur to those skilled in the art. Alternations, modifications, and improvements of the disclosed invention, though not expressly described above, are nonetheless intended and implied to be within spirit and scope of the invention. Accordingly, the foregoing discussion is intended to be illustrative only; the invention is limited and defined only by the following claims and equivalents thereto.

We claim:

1. A three-dimensional puzzle comprising:

a shell having at least four faces and formed by multiple shell segments, at least some of the shell segments being movable relative to adjacent shell segments;

a core within the shell, the at least some of the shell segments being repositionable relative to the core, and the faces being freely to rotatable relative to the core about axes extending from the core toward the faces;

a plurality of unique signatures, each located at one of the at least some of the shell segments;

system electronics at the core; and at least one optical sensor, each optical sensor configured to capture an image of multiple shell segments to enable the system electronics to detect an identity and orientation of multiple shell segments based on the unique signatures.

2. The three-dimensional puzzle of claim 1, further configured to determine a current shell segment pattern of the shell based, at least in part, on the detected identity and orientation.

3. The three-dimensional puzzle of claim 2 further comprising:

processing circuitry;

wherein the processing circuitry is located within the shell and configured to determine the current shell segment pattern.

4. The three-dimensional puzzle of claim 1, wherein each unique signature represents colors of all face segments of its corresponding shell segment.

5. The three-dimensional puzzle of claim 1, wherein:

the shell has six faces, which form a cube;

the shell segments are six central cubelets, eight vertex cubelets, and twelve central edge cubelets, the central cubelets each being on a different face of the shell and each being supported by contacting a separate post extending from the core along the axis of rotation of its respective face; and the at least some of the shell segments include the eight vertex cubelets and the twelve central edge cubelets.

6. The three-dimensional puzzle of claim 1, further comprising:

at least one mirror directing images of the unique signatures toward the at least one optical sensor.

7. The three-dimensional puzzle of claim 1, further comprising:

at least one lens directing images of the unique signatures toward the at least one optical sensor.

8. The three-dimensional puzzle of claim 1, further comprising:

a light source directed to illuminate the unique signatures.

9. The three-dimensional puzzle of claim 1, wherein the optical sensor views all unique signatures simultaneously.

10. The three-dimensional puzzle of claim 1, comprising:

a power source located at the core, wherein the power source is accessible for charging through at least one of the shell segments.

* * * * *